United States Patent [19]

Naylor

[11] 4,009,357

[45] Feb. 22, 1977

[54] ANTI-STATIC KEYLOCK SWITCH

[75] Inventor: Herbert C. Naylor, Carpentersville, Ill.

[73] Assignee: Oak Industries Inc., Crystal Lake, Ill.

[22] Filed: Oct. 1, 1975

[21] Appl. No.: 618,407

[52] U.S. Cl. ..... 200/42 R
[51] Int. Cl.[2] ..... H01H 27/00
[58] Field of Search ..... 200/42 R, 44, 293

[56] References Cited

UNITED STATES PATENTS

| | | | |
|---|---|---|---|
| 2,062,928 | 12/1936 | Phelps | 200/42 R |
| 2,862,110 | 11/1958 | Bonvissuto | 200/42 R |

*Primary Examiner*—Herman J. Hohauser
*Attorney, Agent, or Firm*—Kinzer, Plyer, Dorn & McEachran

[57] ABSTRACT

An anti-static keylock assembly includes a keylock device having a rotatable locking element; an adapter formed of a plastic material interlocked with the keylock device; a terminal assembly formed of a plastic material interlocked with the adapter; and a rotor assembly formed of a plastic material positioned within the terminal assembly and having a shaft interlocked with the locking element of the keylock assembly. A plurality of terminals extends outwardly from the terminal assembly with one of the terminals being centrally located and rotatably supporting a rotor contact which is attached to the rotor assembly. The remaining terminals are circumferentially positioned about the center terminal. Rotation of the keylock assembly effects rotation of the rotor contact and thus changes the electrical connections between the terminals.

13 Claims, 4 Drawing Figures fig. 1.
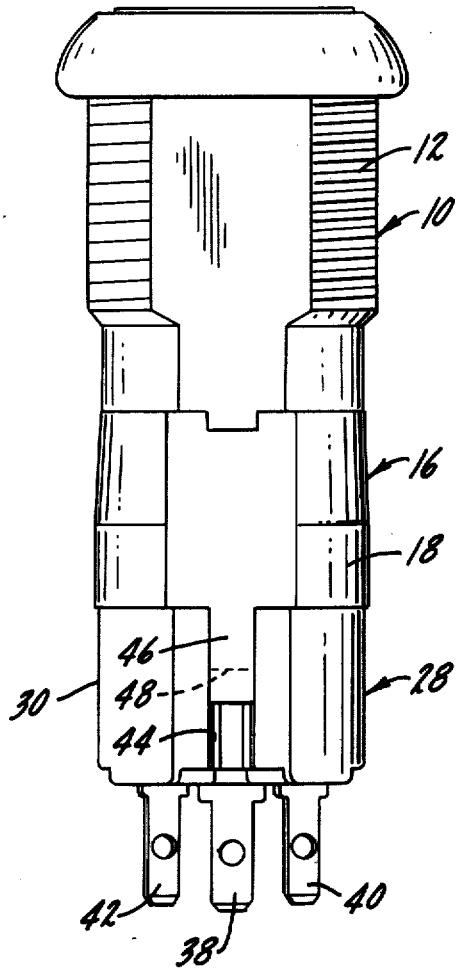
fig. 3.
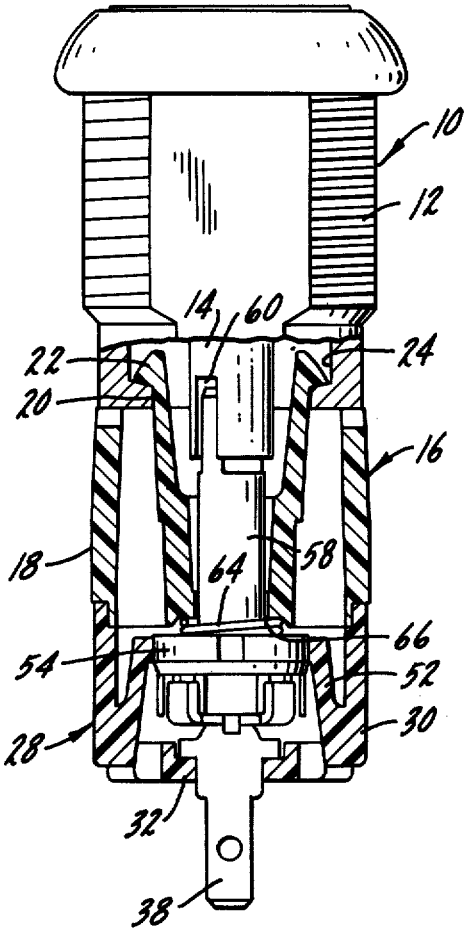
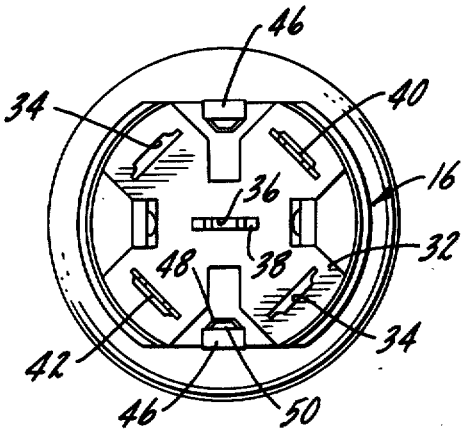
fig. 2.

ANTI-STATIC KEYLOCK SWITCH

SUMMARY OF THE INVENTION

The present invention relates to an anti-static keylock assembly and particularly to such an assembly in which a number of elements thereof are formed of an electrically non-conductive material such as plastic.

One purpose of the invention is a simply constructed reliably operable anti-static keylock assembly providing electrical isolation between the keylock device and the electrical terminals.

Another purpose is an anti-static keylock assembly in which the rotor contact pivotally rotates upon one of the electrical terminals.

Another purpose is an anti-static switching assembly arranged to be attached to a conventional keylock device.

Other purposes will appear in the ensuing specification, drawings and claims.

BRIEF DESCRIPTION OF THE DRAWINGS

The invention is illustrated diagrammatically in the following drawings wherein:

FIG. 1 is a side view of the anti-static keylock assembly disclosed herein,

FIG. 2 is a bottom view of the assembly of FIG. 1,

FIG. 3 is a partial vertical section through the assembly of FIG. 1, and

DESCRIPTION OF THE PREFERRED EMBODIMENT

Figure 4:
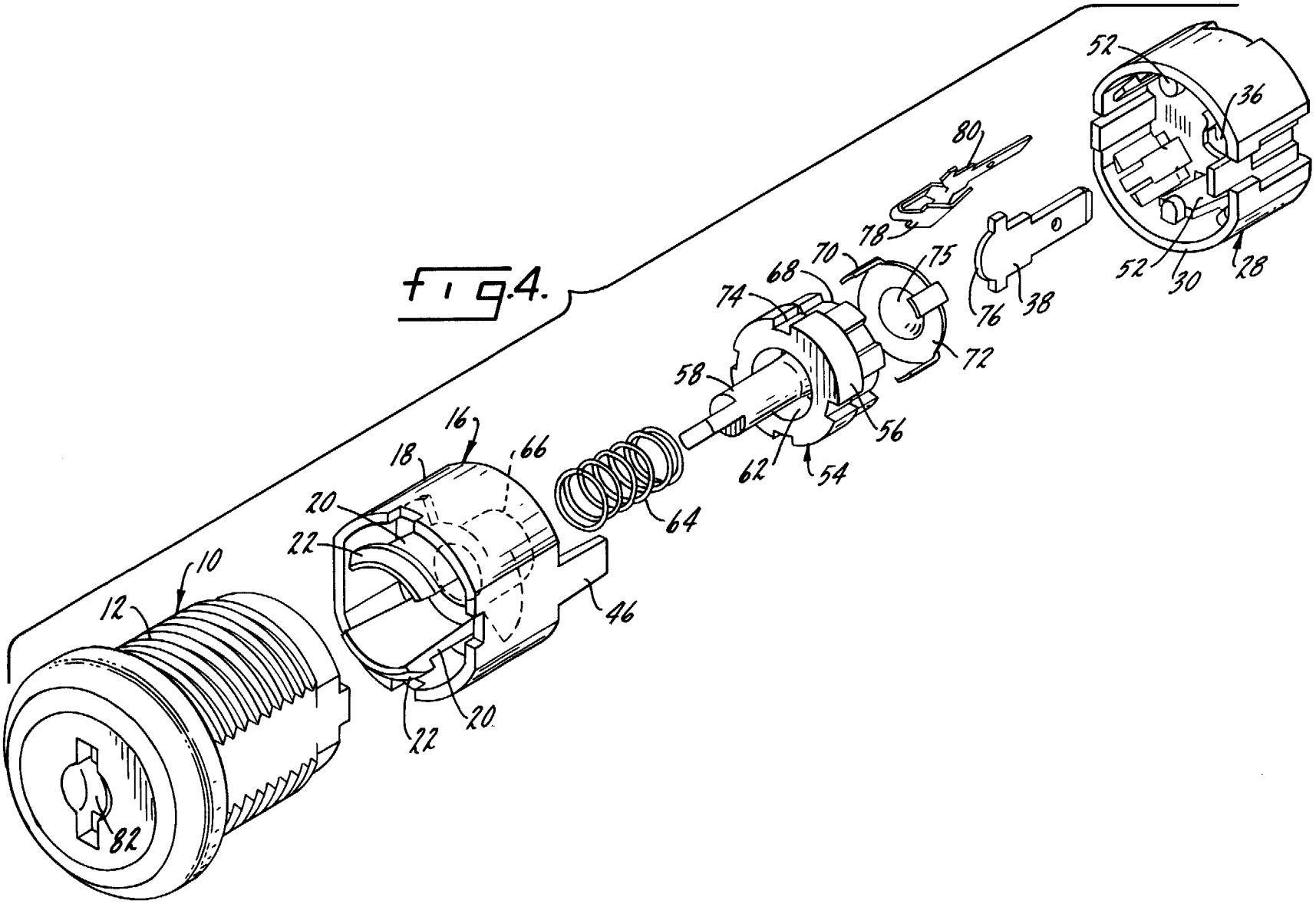
FIG. 4 is an exploded view of the assembly of FIG. 1.

The present invention relates to an anti-static keylock/switch assembly which utilizes a conventional keylock and plastic adapter means to connect the keylock with a switch assembly. The keylock is electrically isolated from the switch terminal areas preventing static electrical charge from passing between the switch terminal areas and the keylock.

In the drawings, the keylock assembly, which may be conventional, is indicated generally at 10 and may be cylindrical in form with an external thread 12 for use in attachment to an instrument panel. The keylock assembly may have a rotatable locking element 14 which extends outwardly therefrom.

A generally cylindrical adapter is indicated at 16 and includes a cylindrical outer housing 18 and integral inner generally axially extending and partially circumferential projections 20. The projections 20 extend into the keylock device 10 and have outwardly-directed hook portions 22 which fit within a mating recess 24 at the end of the keylock device. Thus, the adapter is mechanically attached to the keylock device.

Attached to the end of adapter 16 opposite to the keylock device is a terminal assembly 28 having a generally cylindrical outer housing 30 and a bottom 32. Looking particularly at FIG. 2, the bottom 32 of terminal assembly 28 may include a plurality of circumferentially arranged terminal openings 34, there being four such openings illustrated. The switch assembly is adapted to mount a maximum of five terminals, although, depending upon the particular switching operation, there may be less. An opening 36 is centrally positioned within bottom 32 and a terminal 38 extends outwardly therefrom. Terminals 40 and 42 are positioned within two of the openings 34 and also extend outwardly from the terminal assembly.

The terminal assembly may have oppositely positioned exterior grooves 44 which will receive mating axially extending arms 46 which are integral with adapter 16. Each of the grooves may have a shoulder 48 which will cooperate with inwardly-extending hook-like portions 50 to secure the terminal assembly to the adapter. After such attachment the two assemblies may be permanently secured together by means of ultrasonic welding or the like.

A rotor assembly 54 includes a generally cylindrical portion 56 and an integral shaft 58 extending into a notch 60 formed in the rotatable locking element 14 of keylock device 10. Thus, the keylock device and the rotor assembly are interlocked for simultaneous rotation when a key is turned in the lock. A well 62 is formed between shaft 58 and cylindrical portion 56 of the rotor assembly and a coil spring 64 may bottom within the well and extend into contact with a lower annular surface 66 of adapter 16.

One end of cylindrical portion 56 of the rotor assembly has a plurality of axially extending grooves 68 which are formed and adapted to receive arms 70 of a rotor contact 72 to secure the rotor contact to the rotor assembly. There are additional axially extending grooves 74 in the cylindrical portion 56 of the rotor assembly, which grooves cooperate with terminal assembly arms 52 to form detent means for rotatably positioning the rotor assembly within the terminal assembly. There are two arms 52 integral with the plastic terminal assembly and these arms, being flexible, will move in and out of grooves 74 as the rotor assembly rotates relative to the terminal assembly.

Terminal 38, as illustrated particularly in FIG. 4, has a dome-shaped end 76 which will extend into and support rotor contact 72 and its dome-shaped center 75. Thus, as the rotor assembly rotates, it will rotate on the dome section 76 of terminal 38 and there will be continuous electrical and mechanical contact between terminal 38 and rotor contact 72.

Terminals 40 and 42 are identical, and one such terminal is illustrated in FIG. 4. The contact has a spring-like arm portion 78 which extends inwardly from contact body 80. Arm portion 78 is adapted to be placed in contact against one of arms 70 of rotor contact 72, when these elements are positioned opposite each other, thus completing an electrical connection between the rotor contact and the terminal.

In operation, when a key is inserted in keylock opening 82, rotation of the key will cause rotation of rotor assembly 54 and its attached rotor contact 72. The rotor and rotor contact will turn until the rotor has been indexed from one detented position to the next adjacent position. Depending on the arrangement of terminals 40 and 42, the electrical circuits between these terminals and terminal 38 will be opened and closed by such rotation.

Of particular advantage is the fact that all of the elements connecting the switching portion of the assembly with the keylock device are formed of electrically non-conductive material, isolating the switching area and the keylock area, and thus preventing any passage of static electricity to the keylock area.

The adapter, terminal assembly and rotor are all simply constructed, reliable plastic elements which may be easily interlocked together to form a secure unit. Although only two terminals are shown in the terminal assembly, depending upon the switching function there may be more such terminals and the invention should not be limited to any particular number.

Whereas the preferred form of the invention has been shown and described herein, it should be realized that there may be many modifications, substitutions and alterations thereto.

The embodiments of the invention in which an exclusive property or privilege is claimed are defined as follows:

1. An anti-static keylock assembly including a keylock device having a rotatable locking element, an adapter formed of an electrically non-conductive material, cooperating means on said adapter and keylock device forming an interlock therebetween, a terminal assembly formed of an electrically non-conductive material and cooperating means on said adapter and terminal assembly forming an interlock therebetween, a rotor assembly formed of an electrically non-conductive material positioned within said terminal assembly and having a shaft extending toward and interlocked with said rotatable locking element, a pair of electrical terminals extending outwardly from said terminal assembly, a rotor contact carried by said rotor assembly and rotatable to a position to form an electrical connection between said terminals.

2. The structure of claim 1 further characterized in that one of said terminals is generally centrally located in said terminal assembly and is in continuous contact with said rotor contact, said rotor contact being rotatable upon said center terminal during operation of said keylock device.

3. The structure of claim 2 further characterized by and including a plurality of terminals circumferentially positioned about said center terminal and positioned for contact by portions of said rotor contact.

4. The structure of claim 3 further characterized in that said center terminal has an inwardly extending dome, said rotor contact having a cooperating dome generally centrally located thereon, with said terminal dome extending within said rotor contact dome for rotational support of said rotor contact.

5. The structure of claim 4 further characterized in that said rotor contact has a plurality of arms extending generally axially of said rotor assembly, said arms being positioned for contact with said plurality of circumferentially arranged terminals.

6. The structure of claim 1 further characterized by and including a coil spring encircling said rotor assembly shaft and compressed between said rotor assembly and adapter.

7. The structure of claim 1 further characterized in that the cooperating means forming an interlock between said adapter and terminal assembly includes a pair of spaced axially extending exterior arms on said adapter and a pair of mating exterior grooves on said terminal assembly.

8. The structure of claim 7 further characterized by and including inwardly extending hook portions on each of said axially extending arms and mating recesses formed in said terminal assembly grooves.

9. The structure of claim 1 further characterized in that the interlock between said keylock device and said adapter include a pair of circumferentially and axially extending projections integral with said adapter and extending into said keylock device.

10. The structure of claim 9 further characterized in that each of said circumferentially and axially extending adapter projections include outwardly extending hook portions, a recess in said keylock device, with the hook portions fitting within said recess when said members are interlocked together.

11. The structure of claim 1 further characterized in that said adapter, rotor assembly and terminal assembly are all formed of a plastic material.

12. The structure of claim 1 further characterized by and including cooperating detent means on said rotor assembly and terminal assembly.

13. The structure of claim 12 further characterized in that said detent means includes arms integral with said terminal assembly and mating grooves on the exterior of said rotor assembly.

* * * * *